US005087145A

United States Patent [19]

Cooley

[11] Patent Number: 5,087,145

[45] Date of Patent: Feb. 11, 1992

[54] TRADING CARD HOLDER

[76] Inventor: Gregory S. Cooley, 16041 Beatrice, Allen Park, Mich. 48101

[21] Appl. No.: 681,219

[22] Filed: Apr. 5, 1991

[51] Int. Cl.[5] ..... B42F 13/00

[52] U.S. Cl. ..... 402/79; 402/8; 281/38; 206/456

[58] Field of Search ..... 402/79, 8; 281/38; 206/489, 456, 425

[56] References Cited

U.S. PATENT DOCUMENTS 4,629,070 12/1986 Robens ..... 402/79

4,824,273 4/1989 Silva et al. ..... 402/79

*Primary Examiner*—Timothy V. Eley

*Assistant Examiner*—Willmon Fridie, Jr.

[57] ABSTRACT

A trading card holder constructed from semi rigid, or rigid, clear material is used to protect valuable trading cards from wear. In one embodiment, the trading card holder includes a back plate and a plurality of cover plates. The cards to be displayed by the holder are sandwiched between the cover plate and the back plate thereby rendering them immovable. In a second embodiment the card display holder includes a single back plate and a single cover plate. The two plates are connected by way of a hinge member which allows the two plates to be separated for removing or installing cards into the holder system. A plurality of holes or Velcro strips are fitted along one edge of the card holder thereby allowing multiple card holders to be inserted into a binder system.

19 Claims, 2 Drawing Sheets

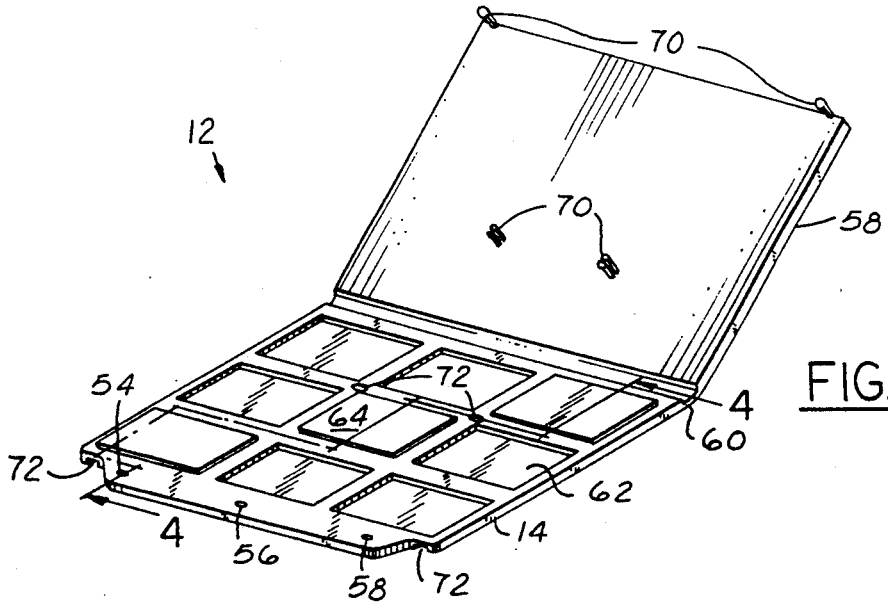
FIG.3
FIG.4
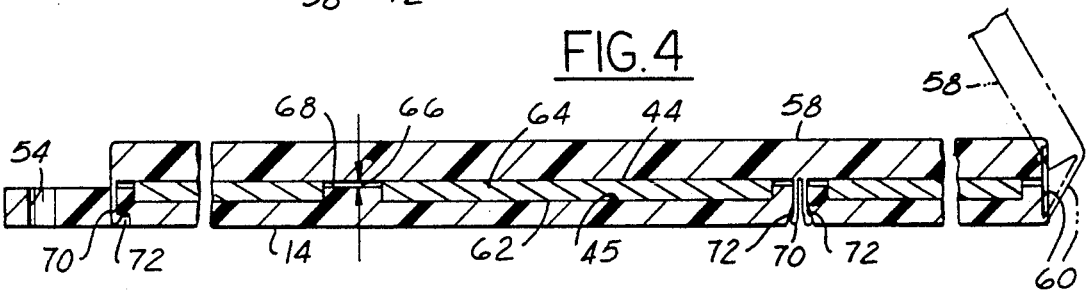
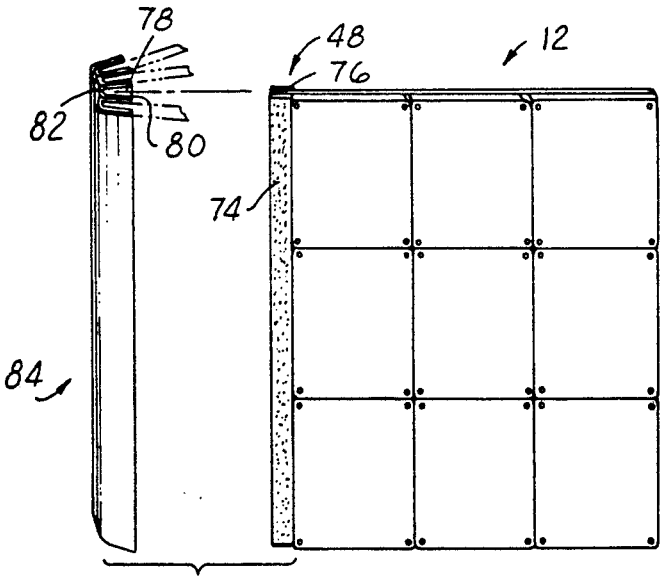
FIG.5
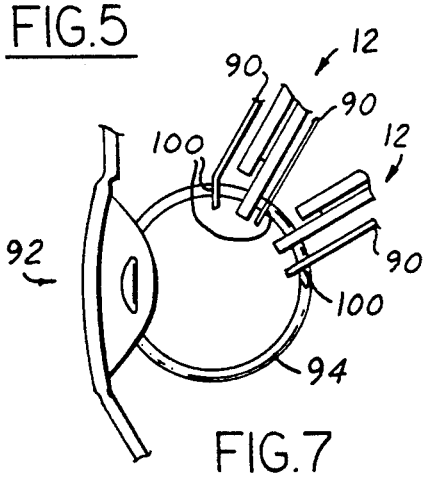
FIG.7
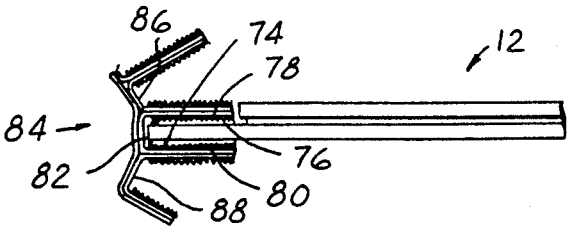
FIG.6

TRADING CARD HOLDER

TECHNICAL FIELD

The present invention generally relates to display systems, and more particularly relates to a system for displaying valuable trading cards and the like.

BACKGROUND OF THE INVENTION

Display systems for displaying baseball cards, stamps and the like are well known in the art. For example, U.S. Pat. No. 4,860,468 issued to Cliborn on Aug. 29, 1989 discloses a windowed matrix display for baseball cards and similar objects. Likewise, a stamp album is disclosed in U.S. Pat. No. 3,685,187 issued to Hillmer on Aug. 22, 1972. These two patents are typical of display systems known in the art inasmuch as they disclose a flexible sheet having one or more pockets therein for receiving and retaining the card, stamp or other object to be displayed.

Although holders of this type are widely used for cards, stamps, photographs and the like, it is well known that because they are constructed from pliable materials, the holders are easily bent and contorted. This bending movement causes one or more of the surfaces of the holder to move across one or more of the surfaces of the card, stamp or photograph being stored therein. This relative movement between the card holder and the item being stored within the card holder, causes the indicia present on the stored item to wear. Although this is not a particular problem for cards, stamps, photographs or other items having little monetary value, it can greatly detract from the value of rare or otherwise prized cards, stamps, photographs and the like stored therein.

Along with the undesirability of movement between the stored item and the item holder, it is also known that contact between the corners or edge portions of a card in the card holder can cause the corners and surfaces to become frayed and accordingly reduce the overall value of the card.

Thus, it is desirable to provide a card holder for trading cards, stamps, photographs and the like which preserve the value thereof by preventing any relative movement between the card retaining surfaces of the holder and the card body.

It is also desirable to have a card holder which prevents any contact between the edges or corners of the card and the card holder.

It is also desirable to have a card holder which can be placed in a binder system which is adapted to hold multiple card holders thereby providing a convenient and organized system for storing and displaying valuable cards.

SUMMARY OF THE INVENTION

In light of the foregoing, the present invention provides a trading card display holder for displaying a plurality of trading cards. Each trading card has a first and second opposing planar surface wherein at least one of the surfaces includes printed indicia thereon. One embodiment of the trading card holder comprises a back plate which has a relatively flat card engaging surface. The card engaging surface has sufficient area to engage one of the planar surfaces of at least two of the display cards. A plurality of trading card covers are used to sandwich the trading card to the back plate. Each one of the card covers is respectively associated with one of the trading cards and has relatively flat card engaging surface which is adapted to engage and completely cover one of the planar surfaces of its respectively associated trading card. Each trading card cover includes a means for immovably retaining its respectively associated card between the cover's card engaging surface and the back plate. At least one of the back plate and the card covers is transparent for allowing the printed indicia on at least one of the planar surfaces of each of the trading cards to be viewed therethrough and wherein at least one of the card covers and the back plate is rigid for preventing any substantial flexing movement between the cards, their respective card covers and the back plate. By sandwiching the trading card between its card cover and the back plate, the cards are immovably retained between their respective covers and the back plate in a way which allows the printed indicia placed thereon to be viewed while also preventing the trading cards from bending. In a preferred embodiment, the trading cards are spaced apart and the back plate includes means for securing the back plate into a binder system whereby other said back plates may also be bound.

Preferably at least one of the card covers and the back plate includes a recess adapted to partially receive a trading card.

One embodiment of the back plate securing means includes a plurality of space holes communicating between the card engaging surface and a second surface of the back plate. The holes are adapted to cooperate with a ring binder or the like for binding a plurality of back plates together. An alternative embodiment includes a VELCRO® (or VELCRO type) strip attached to the back plate and the spine of the binder.

Other advantages and meritorious features of the present invention will become more fully understood from the following description of the preferred embodiments, the appended claims and the drawings, a brief description of which follows.

BRIEF DESCRIPTION OF THE DRAWINGS

FIG. 3 is an isometric view of a second embodiment of the display system of the present invention.

FIG. 4 is a side view of the second embodiment of the display system of the present invention.

FIG. 5 is a front view of a third embodiment of the display system of the present invention.

FIG. 6 is a top view of the third embodiment of the display system of the present invention as it relates to a VELCRO binder.

FIG. 7 is a top view of the fourth embodiment of the display system of the present invention as it relates to a three ring binder system.

DETAILED DESCRIPTION OF THE PREFERRED EMBODIMENTS

Figure 1:
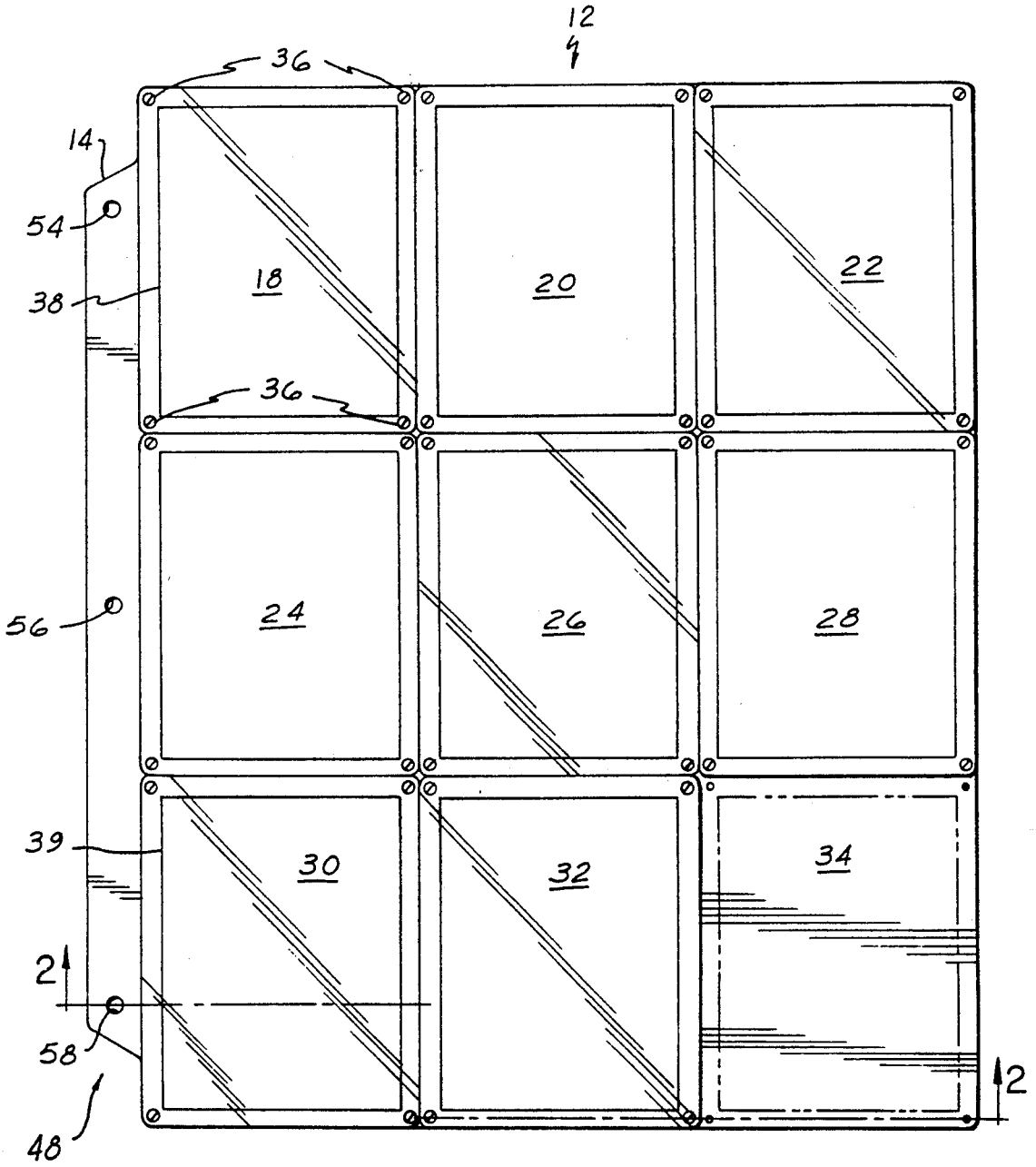
FIG. 1 is a front view of a first embodiment of the display system of the present invention.

Now referring to FIG. 1, trading card display holder 12 includes back plate 14 and a plurality of trading card covers 18–34.

Figure 2:
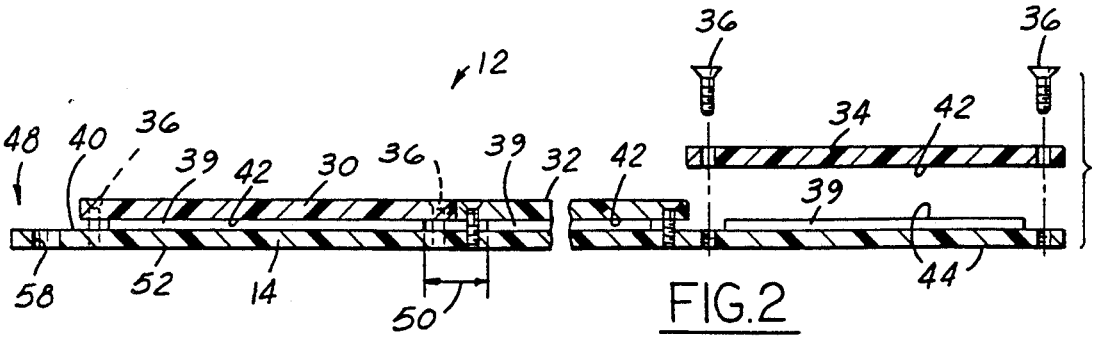
FIG. 2 is a cross-sectional view of the first embodiment of the display system of the present invention taken substantially along line 2—2 of FIG. 1.

Now referring to FIGS. 1 and 2, back plate 14 includes a relatively flat card engaging surface 40 and each trading card cover 18–34 includes a relatively flat card engaging surface 42. These two card engaging surfaces 40, 42 are adapted to engage the opposing, planar surfaces (whenever screws or fastening means 36 are engaged) thereby sandwiching cards 39 therebetween and rendering cards 39 immovable. If covers 18-34 and back plate 14 were constructed of pliable (or flexible) material, it can be easily seen that any bending of card holder 12 would cause card engaging surfaces 40, 42 to move across trading cards 39 thereby causing the indicia printed thereon to wear. This relative movement degrades the value of cards 39, and accordingly the disclosed holder minimizes or prevents this undesirable movement. The present invention prevents this movement by using covers 18-34 or plate 14 which is constructed from a rigid, (substantially nonflexible) material such as plexiglass or the like. By taking this approach, any substantial flexing is prevented and accordingly, any cards stored within trading card display holder 12 are offered such protection. Either trading card covers 18-34 or back plate 14 is constructed from a transparent material thereby rendering any indicia on the cards stored within display holder 12 to be visible. Preferably, both covers 18-34 and back plate 14 are transparent and rigid thereby making both sides of the cards stored on trading card display holder 12 visible while maximizing the protection afforded each enclosed card 39.

It is important to note that because each card is individually accessible, it is not necessary to disturb any adjacent cards while specific cards are being inserted or removed. This feature has the benefit of minimizing or preventing unnecessary movement, bumping or shifting of cards, except for the precise card being added or removed from holder 12. Additionally, because covers 18-34 are completely removed during installation of a new card (or removal of an existing card), no relative movement (or wear) takes place across the printed surfaces 44 of trading card 46. This system of installation and removal is in stark contrast, and much improved upon, the typical installation and removal system of the prior art. Typically, prior art systems involve installing or removing a display card by slipping the card through a slot, or other opening, and sliding the front and rear faces of the card across a surface of the display holder to place the card into its final display position. As mentioned above, this sliding motion causes the card holder to frictionally engage the display surfaces of the card as it is being inserted into, and removed from, the display pocket. As can be seen from FIG. 2, the card holder of the present invention does not necessitate sliding the card across any surface during installation or removal. This feature of the present invention greatly reduces the wear the cards are subject to thereby maintaining each card's potential value.

Additionally, it can be seen from FIG. 2, that once cards 39 are sandwiched between plate 14 and their respectively associated covers 30, 32 and 34, screws (or fastening means) 36 are engaged thereby causing cards 39 to be sandwiched therebetween thereby rendering them immovable. By rendering them immovable, cards 39 cannot slide between plate 14 and their respectively associated cover 30, 32 and 34. If they were free to slide therebetween, it is likely that they would strike fastening means 36 or other surfaces thereby causing the edges and corners of cards 39 to fray, separate or otherwise detract from the overall cards' value. This system is superior to that of the prior art wherein the cards, stamps, photographs and the like are loosely retained in a card holder pocket and the like. Any jarring or substantial movement of the prior art card holder results in collision between the cards corners and edges and the card holder pocket. Thus it can be seen that the engaging and retaining features of the present invention is successful in accomplishing the objectives of the present invention.

Adjacent cards are preferably spaced apart 50 so that there is minimal chance that they can contact or collide with one another while they are inserted or removed from card holder 12.

Plate 14 preferably includes laterally extended portion 48 which extends beyond covers 18-34. Laterally extending portion 48 preferably includes a plurality of holes 54-58 which communicate between card engaging surface 40 of plate 14 and a second surface 52 of plate 14. Holes 54-58 are adapted to engage a ring binder system (such as the three ring binder shown in FIG. 7) for allowing holder 12 to be stored, along with a plurality of like holders in a single binding system.

Now referring to FIG. 3, a second embodiment of the present invention includes back plate 14 connected to single piece cover 58 by way of hinge member 60. In this embodiment, plate 14 is preferably fitted with a plurality of recesses or wells (exemplified at 62).

Now referring to FIGS. 3 and 4 of the drawings, recesses 62 are each respectively associated with a card (exemplified at 64 of FIG. 4). Each recess 62 is made slightly shallower than the depth of a card thereby leaving a slight extension 66 of card 64 above surface 68 of plate 14. By extending card 64 slightly above surface 68 of plate 14, single piece cover 58 is ensured to engage top surface 44 of card 64 while recess 62 is ensured to securely engage bottom surface 45 of card 64. This positive engagement of card 64 between cover 58 and recess 62 of plate 14 guarantees that no relative movement will be experienced by card 64. Male fastening means 70 are placed at various locations along cover 58 and are adapted to cooperatively engage female fastening means 72 placed along plate 14. Thus it can be seen by simply disengaging male fastening means 70 from female fastening means 72 single piece cover 58 can be removed from plate 14 thereby exposing all cards residing therebetween for immediate access.

As was explained in conjunction with the embodiments of FIGS. 1 and 2, holes 54-58 are placed along an extending edge of plate 14 thereby adapting holder 12 for binding into a three ring binder system, or the like. This will be fully explained in conjunction with FIG. 7.

Now referring to FIGS. 5 and 6, in a third embodiment of display holder 12 of the present invention, edge portion 48 is fitted with a front 74 and back 76 VELCRO strips. Front and back VELCRO strips 74, 76 are adapted to engage respectively associated mating VELCRO strips 78, 80. Mating VELCRO strips 78, 80 are joined along one end 82 thereby comprising one segment along the VELCRO binder assembly 84. Additional segments 86, 88 are fastened within binder assembly 84 thereby allowing a number of trading card display holders 12 to be bound within binder assembly 84.

Now referring to FIG. 7, in a fourth embodiment of display holder 12 of the present invention, a plurality of holders 12 are placed in a three ring binder 92. Each ring 94, 96 and 98 (rings 96 and 98 not visible in FIG. 7) are adapted to align with and engage a respective hole 54, 56 and 58 within plate 14. Preferably, a sheet of felt 90 or the like is fitted with a plurality of holes 100, 102 and 104 (holes 102 and 104 not visible in FIG. 7). Each hole 100, 102 and 104 is adapted to align with and engage a respective ring 94, 96 and 98. Felt sheets 90 are adapted to be placed between adjacent holders 12 to prevent the adjacent surfaces of each holder from scratching one another and obscuring the visibility of the stored cards. It is easily seen from FIG. 7, that the binder system of the present invention provides a convenient way to store and display valuable trading cards or the like without endangering the value of the cards. It is also apparent from the system disclosed in FIGS. 3, 5 and 7 that the display system of the present invention has an additional benefit of deterring theft. This is primarily due to the fact that the display systems of the present invention contain multiple cards which necessarily dictates that the pages are wider and longer than display systems containing only one card. Thus, the system of the present invention would be difficult for someone to conceal in their clothing.

The foregoing detailed description shows that the preferred embodiments of the present invention are well suited to fulfill the objects of the invention. It is recognized that those skilled in the art may make various modifications or additions to the preferred embodiments chosen here to illustrate the present invention, without departing from the spirit of the present invention. For example, screws (or fastener means) 36 could include any number of well known utility fasteners including molding a fastener directly into cover 30 and plate 14. The molded fasteners can be made from the same material as that used to construct cover 30 and plate 14 or they can be made from different material. Additionally, many different types of material can be used to construct covers 18–34 and plate 14 such as plexiglass, clear or opaque acrylic plastic or any other type of rigid or semi rigid material. Any of which will suffice as long as the trading card sandwiched between the cover and the back plate does not experience any substantial bending or is not otherwise allowed to move. Accordingly, it is to be understood that the subject matter sought to be afforded protection hereby should be deemed to extend to the subject matter defined in the appended claims, including all fair equivalents thereof.

I claim:

1. A trading card display holder for displaying a plurality of trading cards, each trading card of the type having first and second opposing planar surfaces, wherein at least one of said surfaces includes visible indicia thereon, said trading card display holder comprising:

a back plate having a relatively flat card engaging surface, said surface having sufficient area to engage one of said planar surfaces of at least two of said display cards, a plurality of trading card covers, each one of said card covers respectively associated with one of said trading cards, each said card cover having a relatively flat card engaging surface adapted to engage one of the planar surfaces of its respectively associated trading card, and wherein each of said covers includes back plate engaging means for engaging one of said card covers to said back plate, and wherein at least one of said back plate and said card covers is transparent for allowing the visible indicia on at least one of said planar surfaces on each of said trading cards to be viewed therethrough, and wherein at least one of said back plate and said card covers is rigid for preventing any substantial flexing movement between said cards, their respective card covers and said back plate, whereby when each said trading card is sandwiched between the card engaging surface of its respectively associated card cover and said back plate and secured thereto by said engaging means associated with its respectively associated trading card cover, said cards are immovably retained between their respective card covers and said back plate thereby allowing the visible indicia placed thereon to be viewed while preventing said trading cards from bending.

2. The trading card holder of claim 1, wherein said trading cards are spaced apart.

3. The trading card holder of claim 1, wherein said back plate includes means for securing said back plate into a binder system, whereby other said back plates may also be bound.

4. The trading card holder of claim 3, wherein said securing means includes a plurality of spaced holes communicating between said card engaging surface and a second surface of said back plate, said second surface generally planar and parallel to said card engaging surface of said back plate.

5. The trading card holder of claim 3, wherein said securing means includes a VEL CRO strip attached to said back plate.

6. The trading card holder of claim 1, wherein at least one of said card covers and said back plate includes a recess adapted to partially receive a trading card.

7. A trading card display system for displaying a plurality of trading cards, each card of the type having first an second opposing planar surfaces, wherein at least one of said surfaces includes indicia thereon, said trading card display holder comprising:

a binder, a back plate having a relatively flat card engaging surface, said surface having sufficient area to engage one of said planar surfaces of at least one of said display cards wherein said back plate includes means for securing said back plate to said binder, a plurality of trading card covers, each one of said card covers respectively associated with one of said trading cards, each said card cover having a relatively flat card engaging surface adapted to engage one of the planar surfaces of its respectively associated trading card, and wherein each of said card covers includes back plate engaging means for engaging one of said card covers to said back plate, and wherein at least one of said back plate and said card covers is transparent for allowing the indicia on at least one of said planar surfaces on each of said trading cards to be viewed therethrough, and wherein at least one of said back plate and said card covers is rigid for preventing substantial flexing movement between said cards, their respective card covers and said back plate, whereby when each said trading card is sandwiched between the card engaging surface of its respectively associated card cover and said back plate and secured thereto by said retaining means associated with its respectively associated trading card cover, said cards are immovably retained between their respective card covers and said back plate thereby allowing the indicia placed thereon to be viewed while preventing said trading cards from bending, and whereby said back plate is placed in said binder for storage and display.

8. The trading card display system of claim 7, wherein said trading cards are spaced apart.

9. The trading card display system of claim 7, wherein each said card engaging surface of each said trading card cover completely covers one of the planar surfaces of its respectively associated trading card.

10. The trading card display system of claim 7, wherein said securing means includes a plurality of spaced holes communmicating between said card engaging surface and a second surface of said back plate, said second surface generally planar and parallel to said card engaging surface of said back plate and wherein said binder includes a plurality of rings to cooperatively engage said plurality of spaced holes.

11. The trading card holder of claim 7, wherein said securing means includes a VEL CRO strip attached to said back plate and wherein said binder includes a VEL CRO strip to mate with said VEL CRO strip attached to said back plate.

12. The trading card holder of claim 7, wherein at least one of said card covers and said back plate includes a recess adapted to partially receive a trading card.

13. A trading card display holder for display plurality of trading cards, each trading card of the type Having first and second opposing planar surfaces, wherein at least one of said surfaces includes printed indicia thereon, said trading card display holder comprising:

a back plate having a relatively flat card engaging surface, said surface having sufficient area to engage one of said planar surfaces of at least two of said display cards, a trading card cover, said card cover having a relatively flat card engaging surface adapted to engage one of the planar surfaces of a pluralilty of trading cards, and means for engaging said trading card cover to said back plate, thereby retaining said cards between said card engaging surface of said trading card cover and said back plate, and wherein at least one of said back plate and said card cover is transparent for allowing the printed indicia on at least one of said planar surfaces on each of said trading cards to be viewed therethrough, and wherein at least one of said back plate and said card cover is rigid for preventing any substantial flexing movement between said cards, their respective card covers and said back plate, whereby when each said trading card is sandwiched between the card engaging surface of said card cover and said back plate and secured thereto by said retaining means associated with said card cover, said cards are immovably retained between said card cover and said back plate thereby allowing the printed indicia placed thereon to be viewed while preventing said trading cards from bending.

14. The trading card holder of claim 13, wherein said trading cards are spaced apart.

15. The trading card holder of claim 13, wherein said back plate includes means for securing said back plate into a binder system, whereby other said back plates may also be bound.

16. The trading card holder of claim 15, wherein said securing means includes a plurality of spaced holes communicating between said card engaging surface and a second surface of said back plate, said second surface generally planar and parallel to said card engaging surface of said back plate.

17. The trading card holder of claim 15, wherein said securing means includes a VEL CRO strip attached to said back plate.

18. The trading card holder of claim 13, wherein at least one of said card cover and said plate includes a recess adapted to partially receive a trading card.

19. The trading card holder of claim 13, wherein said card engaging surface of said card cover completely covers one of the planar surfaces of each card.

* * * * *